US005799859A

United States Patent [19]

Cheng

[11] Patent Number: 5,799,859

[45] Date of Patent: Sep. 1, 1998

[54] STRUCTURE FOR GOLF CLUB HEAD AND THE METHOD OF ITS MANUFACTURE

[76] Inventor: Jung-Ho Cheng, 18 floor, No. 106, Sec. 2, Ho-Pin E. Road, Taipei, Taiwan

[21] Appl. No.: 812,784

[22] Filed: Mar. 6, 1997

Related U.S. Application Data

[62] Division of Ser. No. 521,735, Aug. 31, 1995, Pat. No. 5,643,108.

[51] Int. Cl.[6] ..... B23K 20/00; B23K 31/00

[52] U.S. Cl. ..... 228/157; 228/190

[58] Field of Search ..... 228/118, 157, 228/164, 190, 193, 1; 473/346; 29/421.1, 428

[56] References Cited

U.S. PATENT DOCUMENTS 5,228,615 7/1993 Iijima et al. ..... 228/157

5,242,102 9/1993 Nicolas ..... 228/262.72

5,603,449 2/1997 Mansbridge et al. ..... 228/157

*Primary Examiner*—Samuel M. Heinrich

*Attorney, Agent, or Firm*—Beveridge, DeGrandi, Weilacher & Young, L.L.P.

[57] ABSTRACT

A golf club head formed by a combined "superplastic forming and diffusion bonding" method. The basic procedures are using three titanium sheets and machining shallow cavities into one of the sheets, which later provides the reinforcing function. Applying stop-off to the area where diffusion bonding is not desired and then sealing the three sheets by welding along their peripheries together with two gas supply tubes. The assembly then is placed into a die and a gas supply is attached. After vacuuming and heating up, the assembled part is subjected to subsequent diffusion bonding and superplastic inflation processes which yield a titanium golf club head with an internally strengthened striking face.

13 Claims, 17 Drawing Sheets

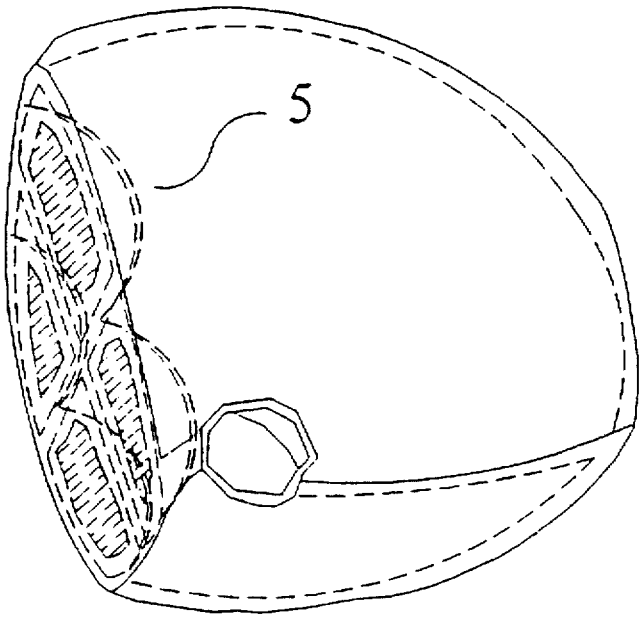
*FIG. 4* B

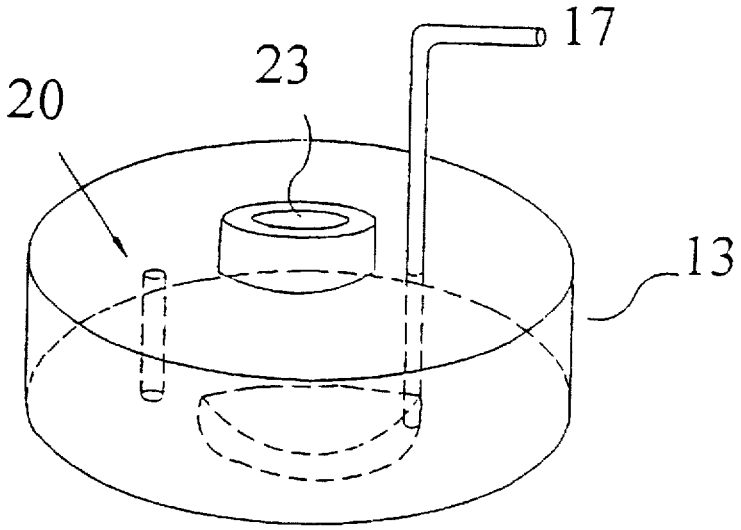
*FIG. 9* A

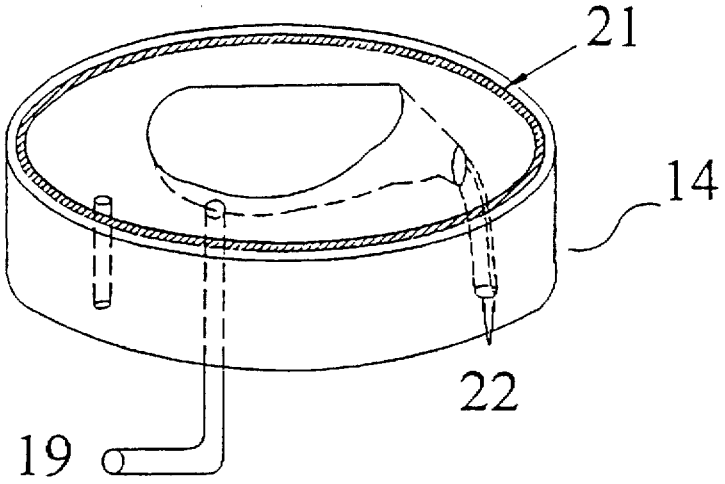
*FIG. 9* B

STRUCTURE FOR GOLF CLUB HEAD AND THE METHOD OF ITS MANUFACTURE

This is a divisional of application Ser. No. 08/521,735 filed on Aug. 31, 1995, now U.S. Pat. No. 5,643,108.

DETAILED DESCRIPTION

1. Field of the Invention

The invention relates to a new structure for a golf club head and method of manufacturing the same, particularly, to a lighter, yet with lower impact energy loss, striking head by using a combined "superplastic forming and diffusion bonding" method for fabricating a titanium alloy golf club head.

2. Background of the Invention

To make an effective and precise golf club head has always been the goal for manufacturers of this field. From traditional heads made by wax mold casting in the past to the fine ceramic heads of the most recent time, they have all contributed efforts to make improvements regarding: lighter weight; longer striking range; and stability during striking of the golf ball.

The most popular revolution in golf club technology of recent years is the hollow metal golf club, so called metal woods which differs from traditional ones by having a hollow metal club head instead of a solid wooden one. This metal wood club head has the advantages of lighter weight, longer striking range, steady ball ballistic and easy maintenance, hence, it has been widely used by all golf players.

The method for fabricating the golf club head is mostly a sand casting technique and the material is stainless steel. In recent years, advanced techniques such as precision investment casting and composite material like reinforced glass fibers have been introduced to make high quality metal wood golf club. Manufacturers are continuously seeking new materials and more advanced techniques for making golf club and its head in order to improve its strength, especially on the striking face of the head. In matching with hollow structure, various internal reinforcements are incorporated based on adequate strength-to-weight and stiffness-to-weight ratios. However, internal reinforcement has often complicated its manufacture process and therefore increased the production costs.

The superplastic forming is realized by using those materials in possession of special substance and combination such as Ti-6A1-4V, which can take a great amount of stretch deformation under certain temperature and strain rates. The superplastic materials required to be equalaxis and micro-grain size in its biphase structure. Generally, the temperature of superplastic processing is above half of its melting point. Its strain rate typically is in the range of $10^{-5}$ to $10^{-3}$ per second. The methods of forming include forging and extrusion, but high pressure blow forming is the most popular method in the aircraft and aerospace industry.

The diffusion bonding is based on the principle of molecular diffusion and boundary movement which allows materials to be bonded in a natural manner under a pressure and temperature below the melting points. Parts made from such bonding differs from those made by traditional bonding methods which leave no sign of melting zone and its joint line is not visible to human eyes. Hence, all those common problems otherwise could occur in the traditional welding such as brittleness caused by heating, can be avoided, and the material is not grossly deformed so that the dimensions of the part remain relatively unchanged due to bonding. The temperature for diffusion bonding generally is between 0.5 to 0.8 times its melting point and the time for bonding is about one to two hours.

Since the conditions for both superplastic forming and diffusion bonding are very similar, especially with their operating pressure and temperature, both production processes can be carried out simultaneously. Therefore, the invention proposed is that of a golf club head fabricated by a combined "superplastic forming and diffusion bonding methods" with titanium alloy.

SUMMARY OF THE INVENTION

The major objective of this invention is to provide a new structure for golf club head which is lighter yet with lower impact energy loss. The striking face featuring internal reinforcement is designed according to research results from impact mechanics.

The new structure of golf club head is designed following two directions:

(1) keeping its weight similar to the current standard stainless steel head while lowering the kinetic energy loss during the impact; (2) reducing the weight of club head while maintaining the same energy loss.

The other major objective of this invention is to provide a new method for fabricating the above-mentioned golf club head by combining "superplastic forming" and "diffusion bonding" processes with titanium alloy.

The basic procedures are: using three titanium sheets; machining shallow cavities into one of the sheets, which later provides the reinforcing function; applying stop-off to the areas where diffusion bonding are not desired; sealing the three sheets by welding along their peripheries together with two gas supply tubes; placing the assembly into the die and attaching the gas supply; after vacuuming and heating up, the assembled part is subjected to subsequent diffusion bonding and superplastic inflation processes which yield a titanium golf club head with an internally strengthened striking face.

BRIEF DESCRIPTION OF THE DRAWINGS

Other objects, features and advantages of the invention will be apparent from the following detailed descriptions in connection with the accompanying drawings, in which;

FIG. 9 is a schematic drawing of upper and lower dies;

FACTORS TO BE CONSIDERED IN THE DESIGN OF GOLF CLUB HEAD

An ideal golf club demanded by its player should be the one with lighter weight, longer striking range, steady ball ballistic and easy maintenance, etc., The lighter the weight of a club, the easier to control its swing. The design of metal wood club emphasizes on placing the weight on the outer housing of its head, i.e. mass of the club mainly distributed around its head and its stability is better than that of the traditional one. Theoretically speaking, this kind of design will produce greater momentum. This is to say that should a striking point be in the area off-center of the striking face, the deviation caused by this off-center remains very small, thus, it is beneficial to the stability of ball ballistic. Since the mass of a metal wood golf club is divided around its head, i.e. its striking face, sidewall, top and bottom, this will allow the designer to have more room to adjust the mass distribution of club head by changing configuration and thickness distribution in order to improve the momentum and features of the head.

According to the basic concept of physics, we can ascertain that when the velocity of swinging the club is fixed, the heavier club head will deliver longer striking range than the lighter one, however, the player has to apply more strength in swinging the heavier club. Therefore, a reasonable design for a golf club should be worked out under the following fixed conditions: same player; the strength applied in swinging the club is fixed; the angle and distance from the ball in swinging position are fixed; power gained by club head before it hits the ball is fixed. Under all above fixed conditions and assuming that the best configuration for a club head is chosen, then, we can evaluate the striking characters for a club head from a series of energy loss study with various ways of weight distribution and internal reinforcement in designing its structure.

Impact is subjected to an energy loss whether it is big or small. From a mechanics analysis, we can determine the relation between the striking distance of the ball and the energy loss during the impact.

Figure 2:
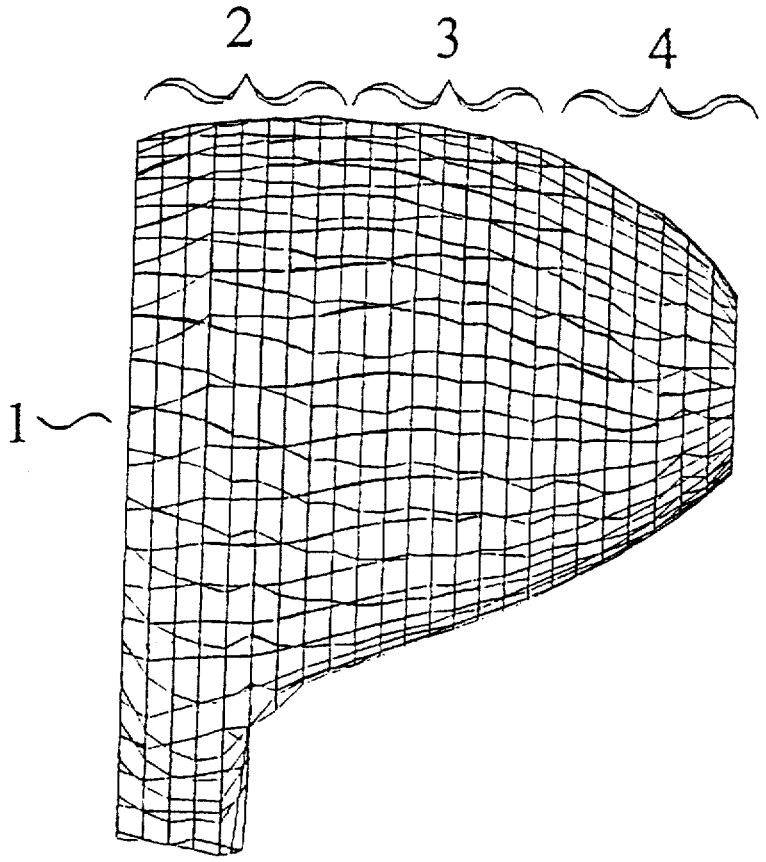
FIG. 2 is a schematic view of golf club head which is roughly divided into three rings, each can be made with a given thickness.

There are two kinds of golf club; one is putter, its head is made of iron and only has a striking face like a piece of knife's edge without any structure behind the striking face. This putter cannot be used to drive the ball for long ranges. Another kind is a metal wood which has a large structure (hereinafter referred as bulb) behind the striking face like a light bulb. This club is adapted for long range striking. We found from experience that the distance of the ball driven by a metal wood is much further than by the putter. Therefore, the bulb of a club head must contribute a certain function during impact in order to obtain longer range. FIG. 2 is a graph showing the relationship between energy loss during impact with various kinds of uniform thickness of club head analyzed by finite elements. We assume that the thickness of a club head is uniform and its initial kinetic is 200 joule. Considering the requirements of strength and ability for diffusion bonding the material chosen for this new club head is Ti-6A1-4V. In order to understand the function of bulb of a club head, FIG. 2 also includes the impact energy loss with the striking face only. It is apparent that the bulb contributes to increase the rigidity of the entire head as well as to reduce its energy loss during impact.

Figure 1:
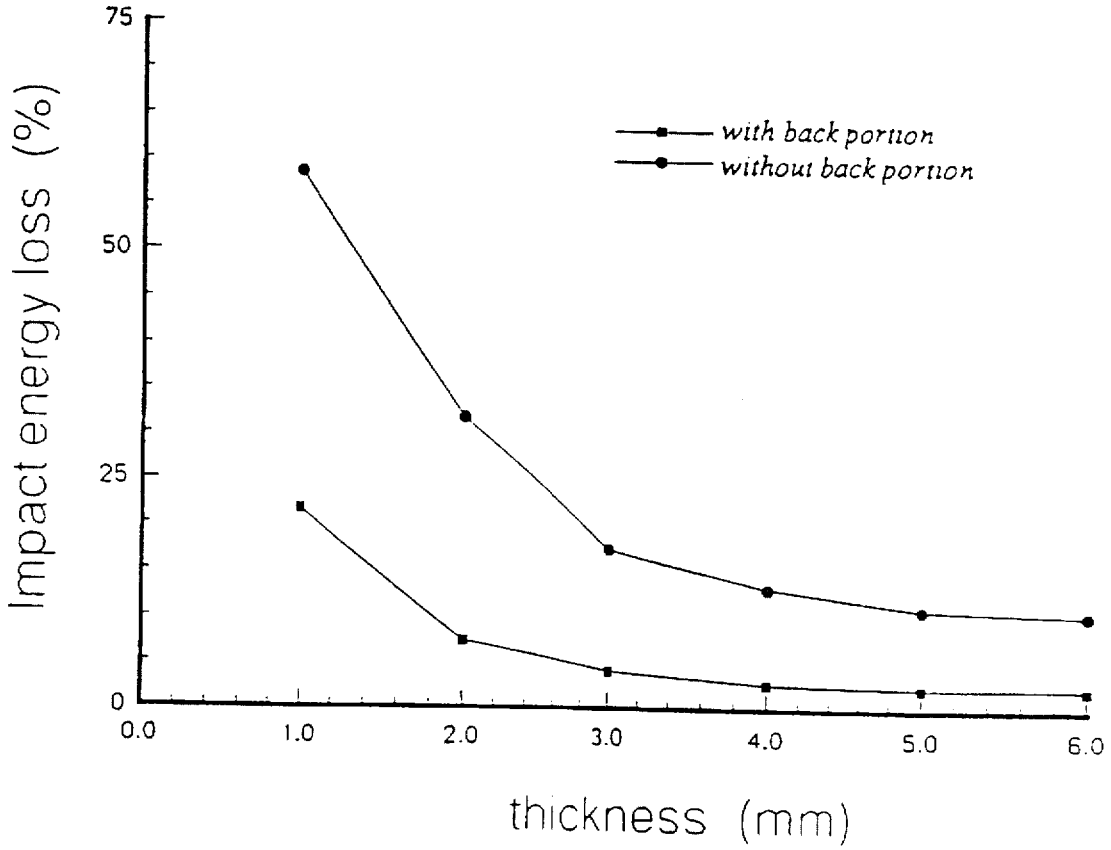
FIG. 1 is a graph showing the relationship between the energy loss during the impact of a ball and a club head of various thickness analyzed by finite element method.

It is also made apparent from FIG. 1 that the amount of energy loss during impact is reduced with the increase of thickness of the head, but the total mass of the head is also increased with it. Although there is no rule to govern the size of club head, there is a limitation on its weight. It is known that the heavier the weight of a club, the more difficult it is to swing it. Therefore, lighter weight is one of the goal in designing a club and an ideal design for the best club is to obtain a compromising combination between its striking feature and its total mass. The key point is to find a best way of distributing the mass, i.e. thickness, around the head so as to improving its striking features while the total mass can be within the limit. In this invention, the upper limit for total mass is 200 grams, which is an average value for No. 1 stainless steel club head.

Figure 3:
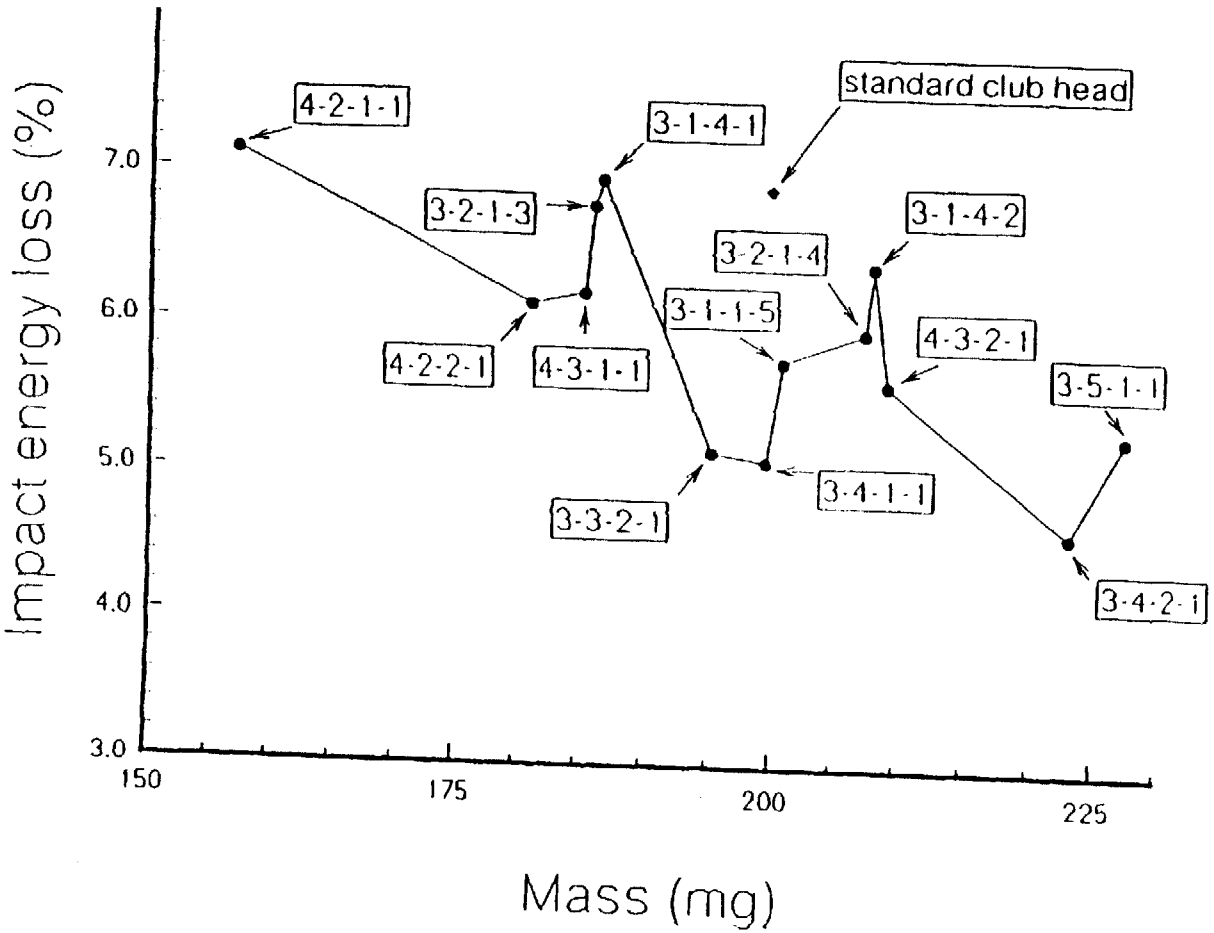
FIG. 3 is a graph similar to that of FIG. 1 with a block at each points containing four numbers each indicating the striking face of FIG. 2, and thickness of the first, second and third rings respectively.

To further determine the functions of the bulb, we roughly divide the head into three rings plus the striking face as indicated in FIG. 2. When the head is so divided, then, we can consider the striking face as a plate and the bulb as its elastic foundation which provides the function of absorbing energy during impact and converts the store strain energy into the kinetic energy of the ball in the course of swing. FIG. 3 shows the impact energy losses versus the mass of club head. Each box in the figure is a different design with the four numbers indicating the thicknesses of striking face, the first, the second, and the third ring, respectively.

From FIG. 3, we can find that the best pattern of thickness distribution which bears a minimum energy loss of 4.62% is 3-4-2-1, however, its total mass excess the upper limit. The next best pattern is 3-4-1-1 which bears an energy loss of 5.09% with a total mass of only 199.23 grams. The point in diamond shape in FIG. 3 is the result of stainless steel club head whose energy loss is 6.9%.

It is clear from the above analysis that the region closest to the striking face, i.e. the first ring, is the most important in striking capacity and required to be thicker than the striking face. In fact, too thick of a striking face not only increases the total weight but also suffers more energy loss during impact.

Figure 4A:
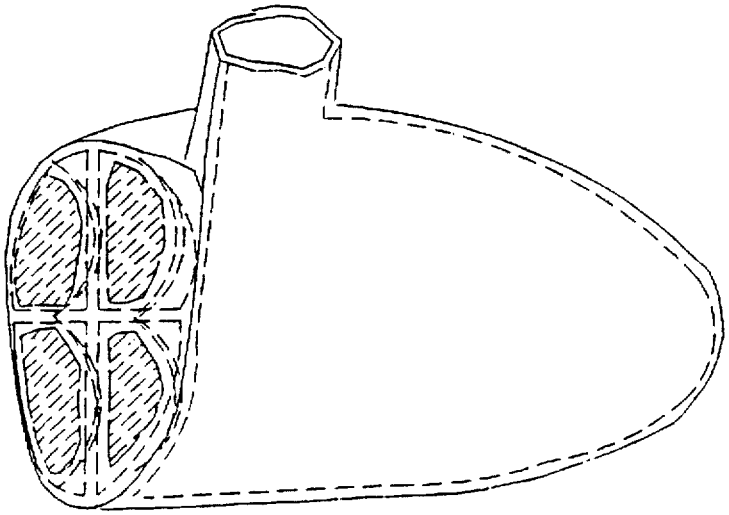
FIG. 4 is a schematic view of a golf club head with a bubble like structure behind its striking face.

We can further reduce the thickness of the striking face by strengthening it with bubble-like structures as shown in FIG. 4. These bubble-like structures cover the entire face and join together with the ring to form a strong support. With the impact analysis, we can carry out the best selection on the number of bubble-like structures, its thickness, its height and its location. It is to be noted that considerable number of patterns can be made with different selection among the above four factors. In the following, we discuss only three examples in order to help understand the characteristics of the new club head as shown in FIG. 4.

Figure 5:
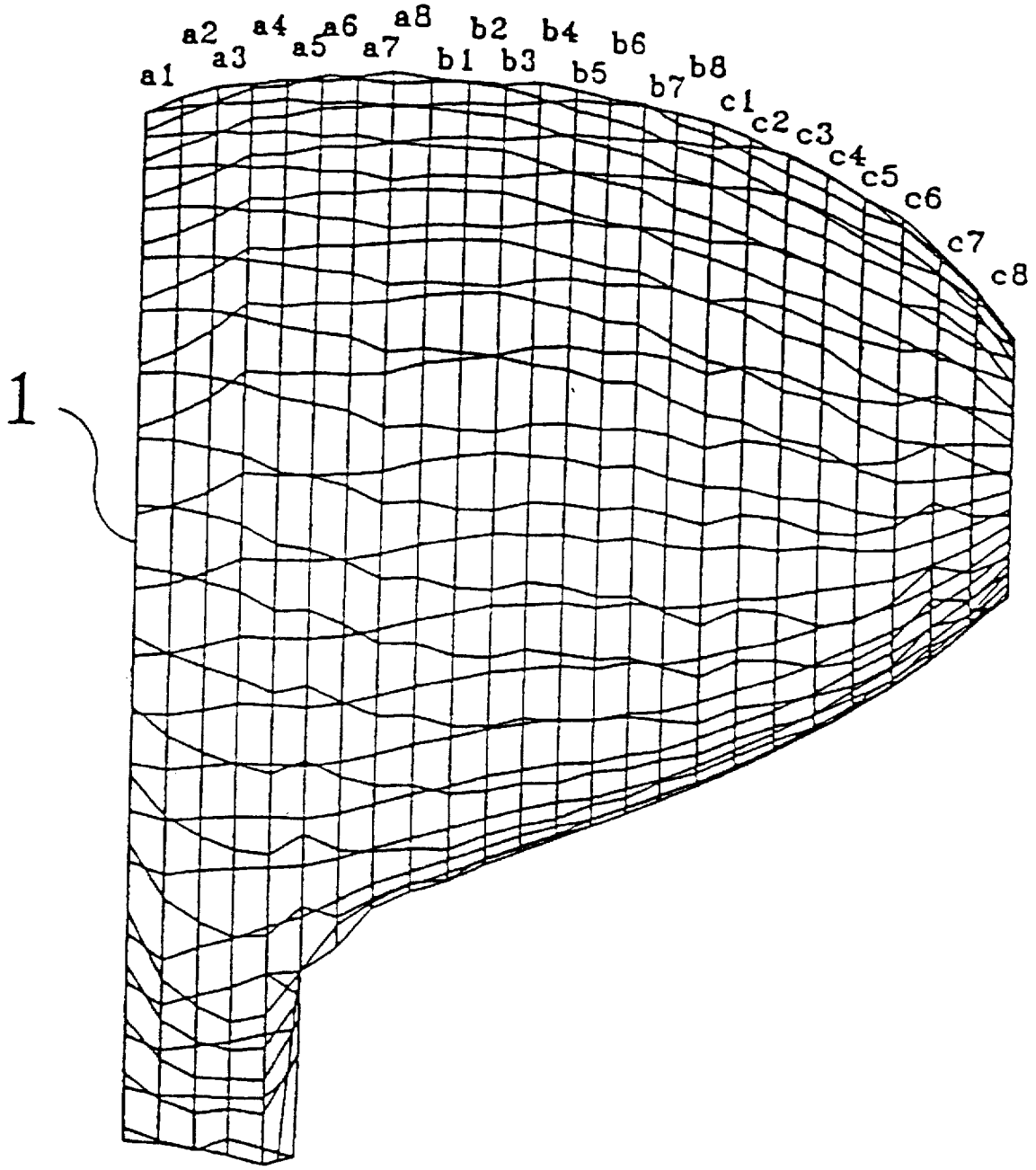
FIG. 5 is a schematic view of a golf club head which is divided into 24 rings, each can be assigned a thichness.

Firstly, the head is further divided into 24 sub-locations (FIG. 5):

A./On the back of striking face, there are four bubble-like structures provided (FIG. 4).

Figure 6:
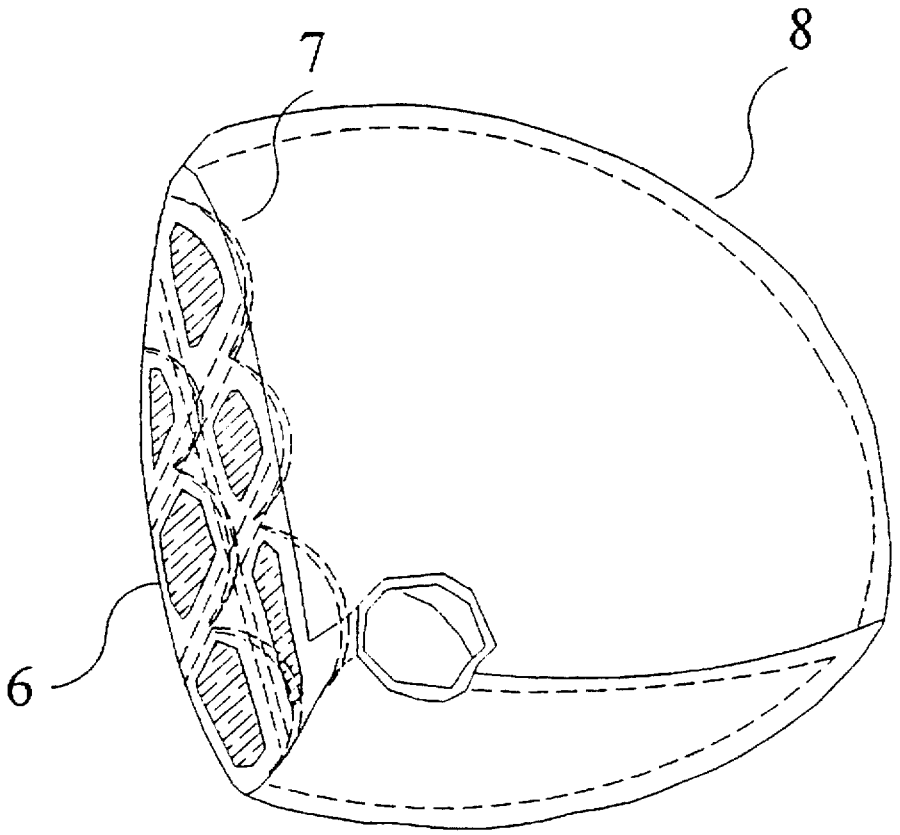
FIG. 6 is a schematic view of a golf club head with six bubbles behind its striking face.

B./On the back of striking face, we can increase the number of bubble-like structures to six and place them closer to the striking face so as to make it as one hollow integrated unit FIG. 6.

Figure 7:
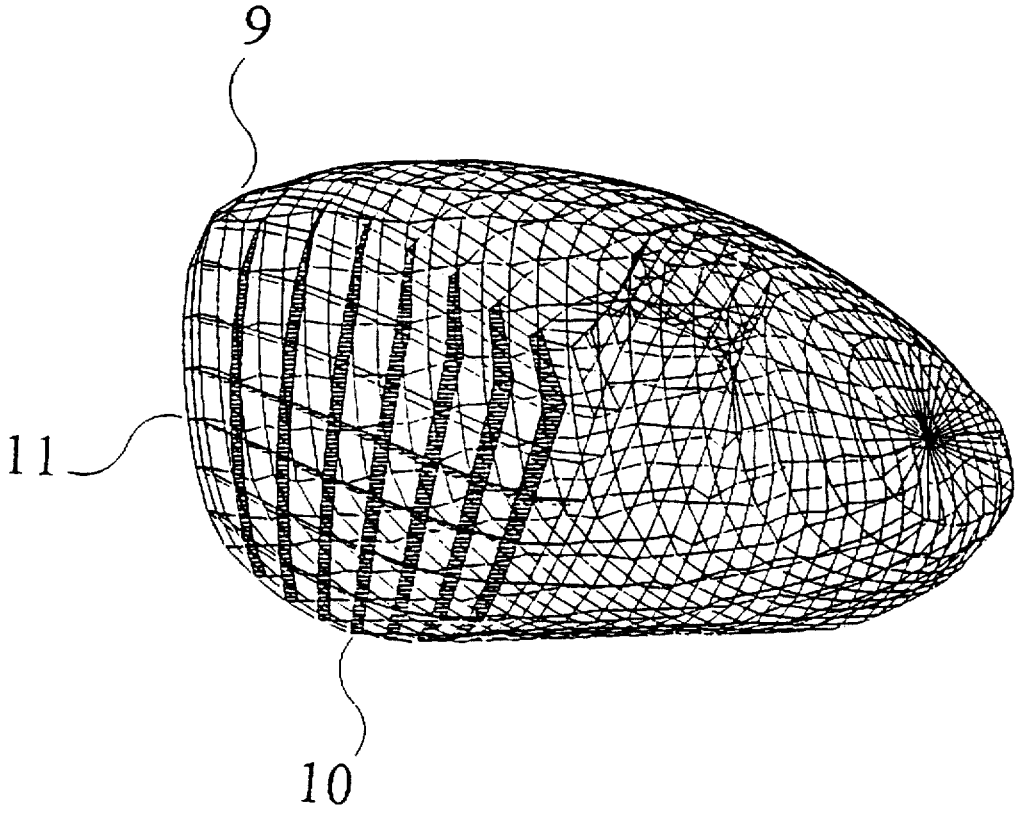
FIG. 7 is a schematic view of a golf club head with a lattice reinforced structure behind its striking face.

C/. Another type of reinforcement can take the form of ladtticd structure as shown in FIG. 7. The structure consists of ribs in crosslink. The number of ribs in horizontal need not be too many but should be all close to the center of striking of the face.

Figure 8A:
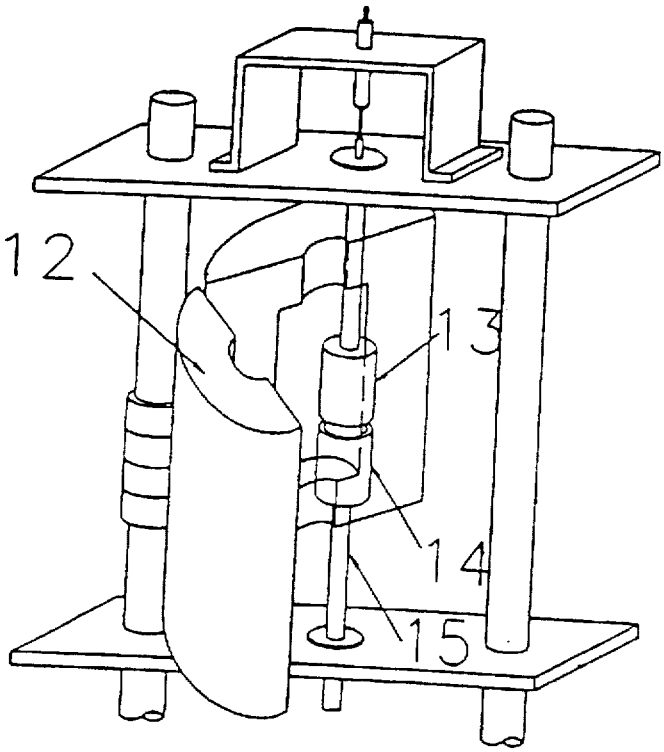
FIG. 8A and FIG. 8B are a schematic representation of the experimental setup for superplastic forming and the layouts of the cooling water and pressure paths.
Figure 8B:
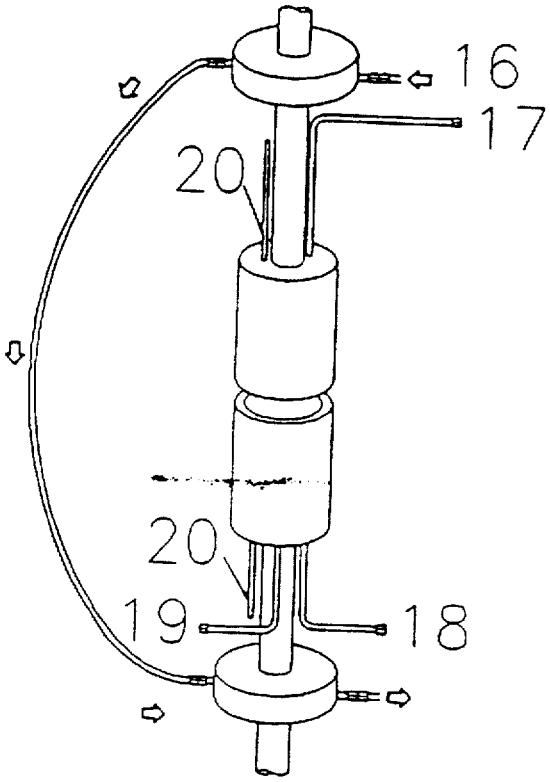

Improved Methods of Fabrication—by Superplastic Forming and Diffusion Bonding:

To accomplish the above design of club head as well as to reduce the cost of its fabrication, the invention proposes a combined superplastic forming and diffusion bonding method for fabricating a titanium alloy golf club head. The experimental setup for superplastic forming and the layout of the cooling water and pressure paths is indicated by FIGS. 8A and 8B. This system basicly comprises:

A furnace chamber, operating on electric resistance heating, is provided with a proper upper temperature limit of 1000° C.

An upper and a lower die (13, 14) are threadly locked on a supporting rod (15). The lower die (FIG. 9) provided with a draw bead (21) which is adapted to press the titanium sheets during blow forming process, or an O-ring made of brass is provided to prevent leakage of gas.

Thermal couples are embedded in both dies. The temperature of the workpiece is calibrated by measured temperature of upper and lower dies.

The supporting rod is connected to an oil system (oil press) which supply necessary strength to press the two dies together.

The cooling system (16) for the supporting rod is also shown in FIG. 8. Cooling water can be directly supplied from faucet, but preferablly supplied from a cooling water system which allows for the control of water temperature.

A vacuum system is installed for purging the air to prevent the titanium sheets from being oxidized under the high temperature. Vacuum system is to operate before argon gas is applied.

Figure 10:
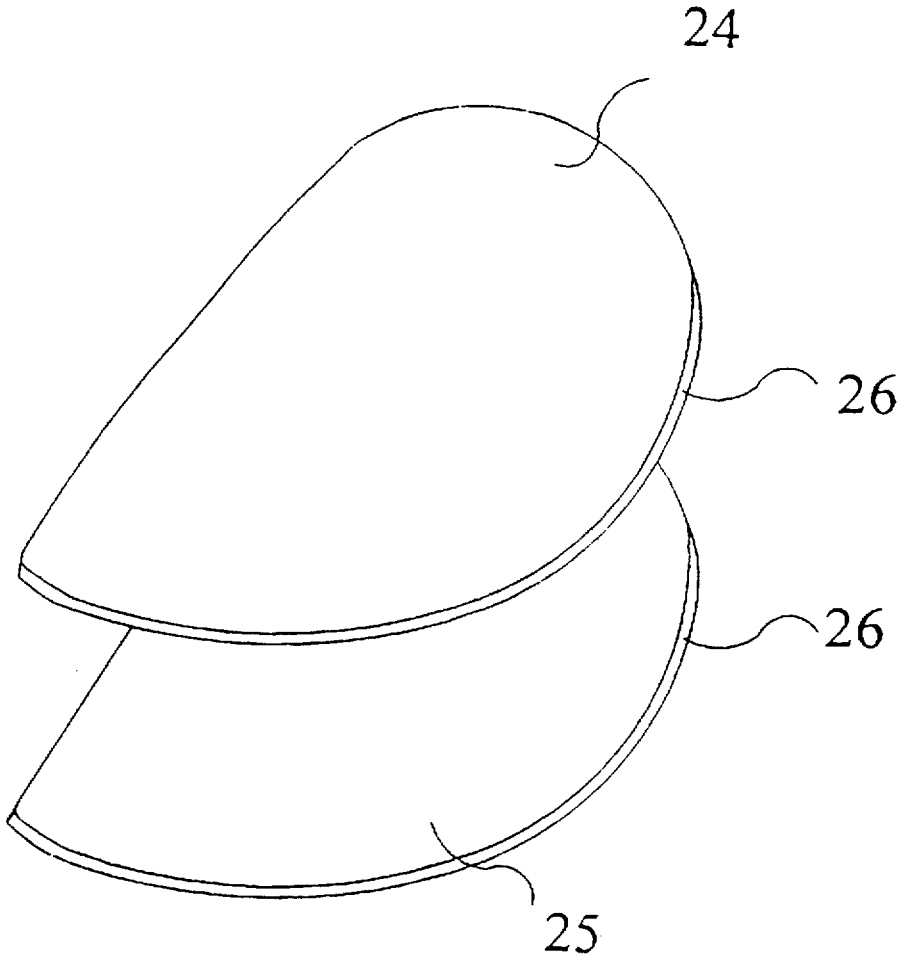
FIG. 10 is a schematic view of two pieces of Ti-6A1-4V sheets in a shape of a striking face for golf club head.

This setup is very easy to be converted into a mass-production system. The operational procedures are:

A Ti-6A1-4V sheet of proper thickness machined into two pieces of face sheets according to specification (24, 25) as shown in FIG. 10. The shape of these two face sheets are close to a projection of upper planar of a club head.

The edges of both top surface of upper sheet and bottom of lower sheet are to be treated to form a hypotenuse of 45 degrees (26).

Cut another Ti-6A1-4V sheet of proper thickness into a in-process shape as striking face which will be called the middle sheet (27).

Figure 11:
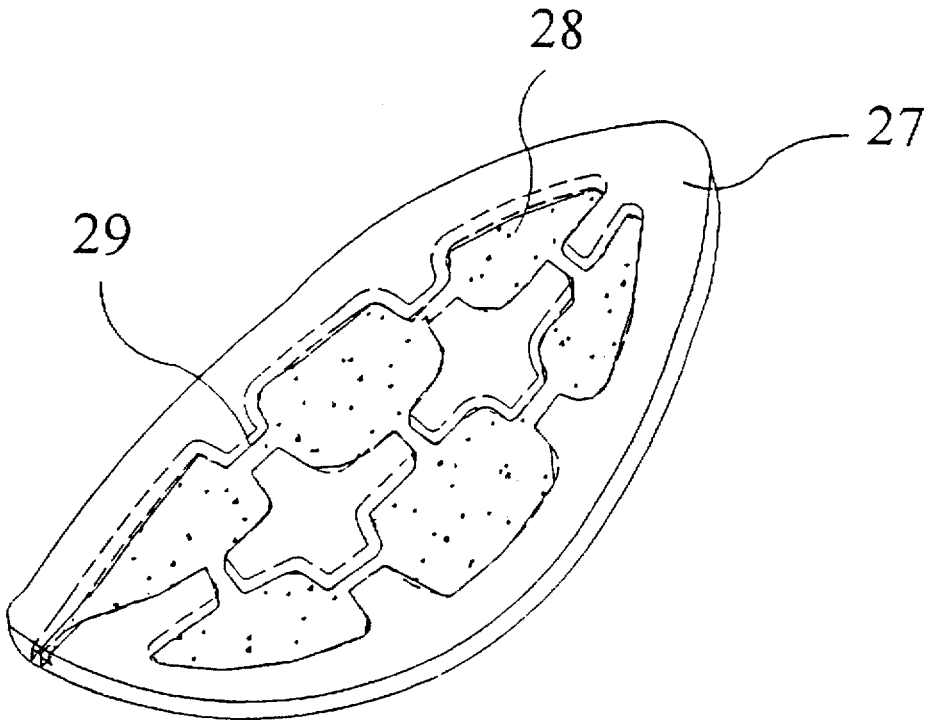
FIG. 11 is a schematic view of cavities in the middle sheet after being treated with acid dip or milling work.

This middle sheet is to be treated with acid dip or milling work so as to form several cavities (28) of 1 mm deep as shown in FIG. 11. Channels should be provided for argon gas between cavities (29).

Figure 12:
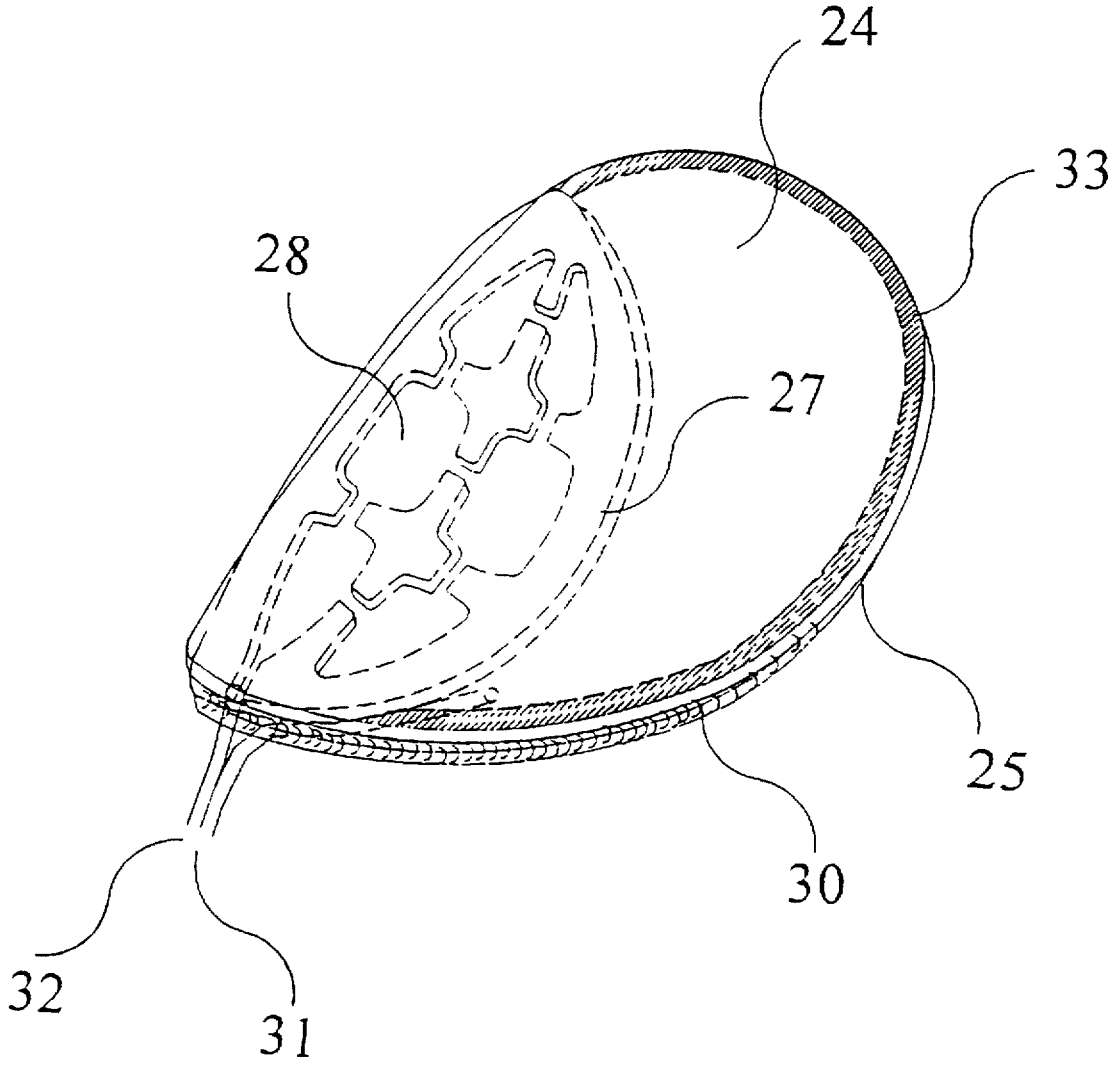
FIG. 12 is a plan view showing formation of three titanium sheets.

Apply stop off material such as Yttrium Oxide on those cavities and inner surface of the upper sheet (24) except those areas needing diffusion bonding as indicated by oblique lines in FIG. 12.

Stack these three Ti-6A1-4V sheets together in such a manner that the cavities (28) are placed in between middle (27) and lower face sheets (25).

Weld these three Ti-6A1-4V sheets together along its periphery (30) of FIG. 12 and also weld two gas tubes (31, 32) into the in-process assmebly. These tubes can be made as a sleeve type and can become a part of club at later time.

Figure 13:
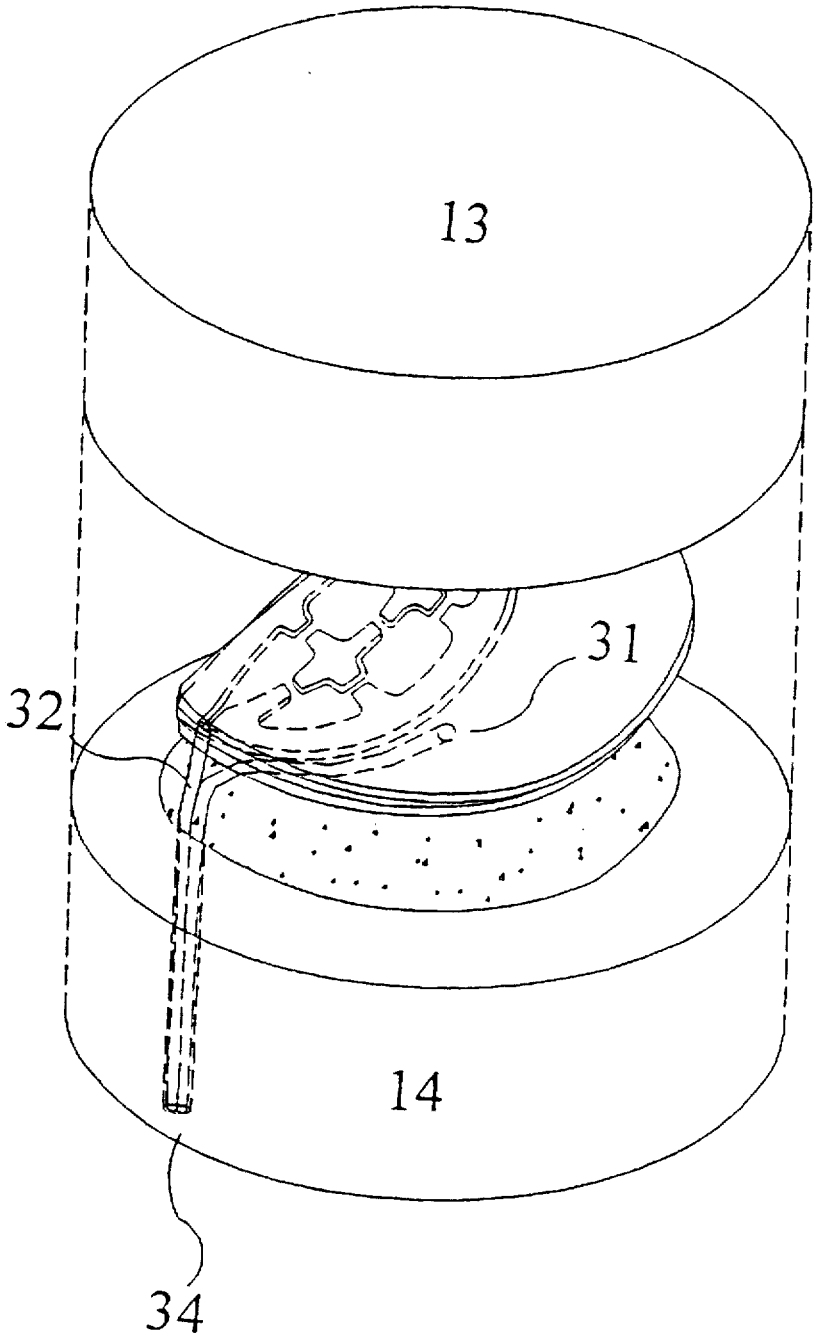
FIG. 13 is a front view showing that three sheets, after assembly, are placed inside the die.

Place the welded in-process assembly into the die as indicated in FIG. 13.

The gas tubes are connected to the argon gas supply pipe line (34).

Place a brass O-ring above the flange (21) on the surface of lower die and activate oil press to raise the lower die against the upper die. The oil pressure at this instance is 50 $Kg/cm^2$.

Close the furnace chamber and start the heating process.

At the begining of heating process, run vacuum extraction to purge the die three times and input a small amount of argon gas to expel the air left in the furnace chamber and to ensure that the vacuum reached below $10^{-3}$ torr.

Five minutes after the die temperature reached to the range between 870° C. to 970° C. (preferably 950° C.) and the temperature difference between upper and lower die is not acceed 5° C., open the pressure valve and start superplastic forming and diffusion bonding process.

Apply argon gas of about 500 psig to cause diffusion bonding around the periphery of two face sheets (upper and lower) and the lands between middle sheet and lower face sheet where no stopoff is applied for a period of about two hours.

Figure 14:
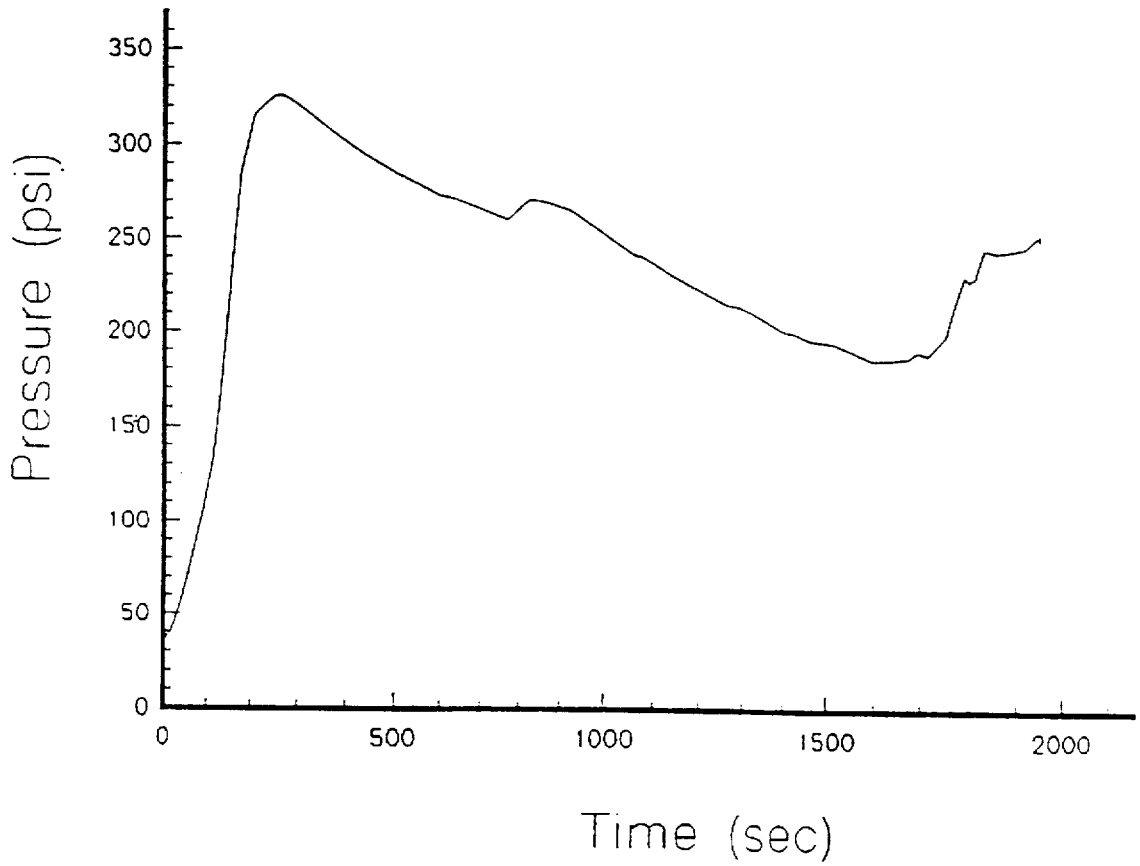
FIG. 14 is a graph showing the pressure-time path for keeping the maximum strain rate under the limit of best superplastic character.

The above process shall be followed by slightly lowering the temperature to the range of 850° C. to 950° C. (preferably 925° C.). At this points, argon gas pressure is applied through one of the gas tubes to the interior of the assembly according to the pressure-time path shown in FIG. 14. The purpose of the pressure-time path is to keep the material deforming within the proper superplastic range. The 500 psig gas pressure previous applied to the die is dropped to 10 psig in order to maintain the function of oxidation protection.

During the superplastic inflation process, the surface of the middle sheet would sink into those cavities (38). Therefore, after completing the superplastic forming, we shall drop the pressure in the tube (31) to 100 psig and inputting pressure of 120 psig through another tube (32) (i.e. the pressure inside the cavities of middle sheet is 20 psig). The resulting golf club head is shown in FIG. 6 or FIG. 7. The difference between FIG. 6 and FIG. 7 is the control of timing for the last part of below forming. The club head of FIG. 6 requires 10 minutes and that of FIG. 7 requires only 5 minutes.

After completion, the argon gas pressure in the various sections should drop to 10 psig before beimg to lower the temperature.

Open the chamber and seperate the upper and lower die in order to take out the work piece.

Through the final stage of finishing process, the product is made to meet the required specifications.

According to the invention, the Ti-6A1-4V golf club head fabricated with a combined "superplastic forming and diffusion bonding" method, is lighter yet with lower impact energy loss than any of the previous club heads. Moreover, with titanium alloy as the main material to design a club head and to be processed through superplastic forming and diffusion bonding method, the total manufacturing costs shall be greatly reduced in comparasion with any of those traditional methods including mold casting and reinforcement.

Although the invention have been described in detail for purposes of illustration, various other ways of designing a club head as well as alternations on the process of superplastic forming and diffusion bonding will also be apparent to those skilled in the art from consideration of specification and practice of the invention disclosed herein. It is intended that the specification and examples be considered as examplary only, with a true scope and spirit of the invention being indicated by the following claims.

REFERENCE NUMBER OF ELEMENTS IN THE DRAWINGS 1 striking face
2 bubb1—1st ring
3 second ring belt
4 third ring belt
5 bubble-like reinforcing structure
6. rainforced striking face
7. bubbles
8. bubb1
9. Supporting plate
10. vertical rib
11. horizontal rib
12. furnace (heating)
13. upper die
14 lower die
15 supporting rod
16 inlet for cooling water
17 inlet for argon gas
18 inlet for inflation gas
19 vacuum extract port
20 thermal couple
21 flange (draw bead)
22. sleeve for argon gas inlet
23. screw flange
24. upper face sheet
25. lower face sheet
26. 45° hypotenuse
27. middle sheet
28. cavities
29. channels for argon gas
30. welding areas
31. 1st inflation gas tube
32. 2nd inflation gas tube
33. diffusion bonding areas
34. inlet port for argon gas

What is claimed is:

1. A method for forming a golf club head, comprising:

providing three metalic sheets;

placing cavitites in one of said sheets;

applying stop-off agent to areas of said sheets where diffusion bonding is not desired;

sealing said three sheets together with two gas supply tubes to form an assembly;

placing said assembly in a die;

attaching a gas supply to said gas supply tubes; and subjecting said assembly to a diffusion bonding process and a superplastic inflation process.

2. The method defined in claim 1, wherein before the step of subjecting said assembly to a diffusion bonding process and a superplastic inflation process, the method further comprises the steps of vacuumizing and heating the assembly.

3. The method defined in claim 1, wherein said three metalic sheets are titaniam sheets.

4. The method defined in claim 1, wherein the step of sealing said three sheets together with two gas supply tubes to form an assembly includes the step of welding the peripheries of said three sheets together with said two gas supply tubes.

5. The method defined in claim 1, wherein said cavities placed in one of said sheets are formed by acid dip treating or mill machining.

6. The method defined in claim 1, further comprising the step of providing said two tubes at a location of the golf club head which allows said two tubes to become part of a golf club.

7. The method defined in claim 1, further comprising the step of maintaining 10 psig argon gas in said die to prevent oxidation of said three sheets.

8. The method defined in claim 1, wherein the step of subjecting said assembly to a diffusion bonding process and a superplastic inflation process includes the step of placing the assembly at a temperature between approximately 870° C. and 980° C. during said diffusion bonding process.

9. The method defined in claim 8, wherein the step of placing the assembly at a temperature between approximately 870° C. and 980° C. during said diffusion bonding process includes the step of placing the assembly at a pressure between approximately 300 psig and 500 psig.

10. The method defined in claim 9, wherein the step of subjecting said assembly to a diffusion bonding process and a superplastic inflation process includes the step of continuing said diffusion bonding process for longer than two hours.

11. The method defined in claim 1, wherein the step of subjecting said assembly to a diffusion bonding process and a superplastic inflation process includes the step of placing the assembly at a temperature between approximately 820° C. and 930° C. during said superplastic inflation process.

12. The method defined in claim 11, wherein the step of placing the assembly at a temperature between approximately 820° C. to 930° C. during said superplastic inflation process includes the step of placing the assembly at a pressure between approximately 10 psig and 500 psig.

13. The method defined in claim 12, wherein the step of subjecting said assembly to a diffusion bonding process and a superplastic inflation process includes the step of limiting a strain rate of said three sheets to be in the superplastic range of approximately $6\times10^{-4}$ per second to $8\times10^{-4}$ per second during said superplastic inflation process.

* * * * *